US007117538B2

(12) United States Patent
Bosne et al.

(10) Patent No.: US 7,117,538 B2
(45) Date of Patent: Oct. 10, 2006

(54) SWING TRAINING JACKET

(76) Inventors: Rene Bosne, 60 West 57th St., #8K, New York, NY (US) 10019; Katarzyna Bosne, 60 West 57th St., #8K, New York, NY (US) 10019

( * ) Notice: Subject to any disclaimer, the term of this patent is extended or adjusted under 35 U.S.C. 154(b) by 81 days.

(21) Appl. No.: 10/418,674

(22) Filed: Apr. 18, 2003

(65) Prior Publication Data

US 2004/0221362 A1 Nov. 11, 2004

(51) Int. Cl.
*A41D 1/02* (2006.01)

(52) U.S. Cl. ..... 2/93; 2/2; 2/85

(58) Field of Classification Search ..... 2/455, 2/456, 69, 97, 84–87, 93, 94, 101, 108, 120, 2/311, 79, 244, DIG. 4, 115, 118; 473/276, 473/277, 266, 409, 131, 212, 229, 206; 434/252
See application file for complete search history.

(56) References Cited

U.S. PATENT DOCUMENTS 1,178,165 A * 4/1916 Lupton ..... 280/810
1,209,311 A * 12/1916 Levinson ..... 2/93
1,995,004 A * 3/1935 Manus ..... 2/93
2,568,304 A * 9/1951 Schoenbrun ..... 119/770
2,659,890 A * 11/1953 Revolta ..... 2/93
2,808,267 A 10/1957 Heaton
3,074,074 A * 1/1963 Lovering ..... 2/94
3,740,052 A 6/1973 Arkin
4,220,299 A * 9/1980 Motter ..... 244/143
4,813,080 A * 3/1989 Toso ..... 2/94
4,892,317 A * 1/1990 Corder, Jr. ..... 473/212
4,940,237 A 7/1990 Mortensen
5,050,885 A 9/1991 Ballard et al.
5,114,142 A 5/1992 Gillespie et al.
5,176,600 A * 1/1993 Wilkinson ..... 482/124
5,188,365 A 2/1993 Picard
5,257,779 A * 11/1993 Dalbo ..... 473/215
5,295,690 A 3/1994 Johnson
5,397,122 A 3/1995 Herridge, II
5,451,060 A * 9/1995 Dalbo ..... 473/215
5,501,464 A 3/1996 Dalbo
5,564,125 A * 10/1996 Waldman et al. ..... 2/93
5,665,015 A * 9/1997 Clark, III ..... 473/409
5,704,846 A 1/1998 Johnson
5,781,930 A * 7/1998 Boshoff ..... 2/93
5,819,315 A * 10/1998 Ruffa ..... 2/69
5,845,336 A * 12/1998 Golde ..... 2/93
5,857,947 A * 1/1999 Dicker et al. ..... 482/124
5,890,968 A 4/1999 Mingo
5,946,724 A * 9/1999 Erickson ..... 2/93
5,951,408 A * 9/1999 Inman ..... 473/212
6,027,413 A 2/2000 Smith et al.

(Continued)

*Primary Examiner*—Alissa L. Hoey
(74) *Attorney, Agent, or Firm*—Alston & Bird LLP

(57) ABSTRACT

The present invention provides a jacket for swing training for a sport requiring swinging of a sports implement. The jacket comprises a body, a first arm and a second arm extending on either side of the body, a front, a back, an interior and an exterior. A first body band encircles the interior portion of the jacket by encircling the body and the interior of the first and second arms. A first wing portion extends from the first arm on the exterior of the jacket, the first wing portion being connected at one end to the first arm and at another end to the exterior of the jacket so that the first wing portion limits the movement of the first arm during a swing.

6 Claims, 2 Drawing Sheets

U.S. PATENT DOCUMENTS 6,126,554 A 10/2000 Poscente
6,176,816 B1 * 1/2001 Dicker et al. ..... 482/124
6,375,581 B1 4/2002 Urban et al.
6,458,036 B1 10/2002 Gutierrez
6,584,619 B1 * 7/2003 Macri ..... 2/456
6,658,666 B1 * 12/2003 Schweer ..... 2/94
6,662,372 B1 * 12/2003 Lewis et al. ..... 2/69
6,698,026 B1 * 3/2004 Schweer ..... 2/94
6,832,960 B1 * 12/2004 Thony ..... 473/277
2002/0039930 A1 4/2002 Smith

* cited by examiner

SWING TRAINING JACKET

TECHNICAL FIELD

The present invention relates to a swing training device, and more particularly, to a jacket for aiding in training arm movement in order to correct faulty swing mechanics.

BACKGROUND

Although many swing training methods and devices are known in the prior art, no known method or device is fully effective in improving athletic performance.

In golf, existing methods often overcomplicate the function as to the swing plane and preferred club positioning, while underestimating the importance of proper setup and how it affects swing mechanics. In fact, many of these existing methods simply reinforce poor mechanics because they fail to properly train all of the parts of the body that are involved in the swing. Trainees who have tried to improve their swings have often given up, commenting that their feel is compromised by the distraction of bearing in mind the many technical points needed to make the adjustments required to correct the faults in their swing.

There have been previous attempts to use external restraints to control movement of the golf swing.

U.S. Pat. No. 4,892,317 issued to Corder, Jr. on Jan. 9, 1990, claims a releasable golf swing training connector that includes a chest strap that encircles a the chest of a golfer and a separate arm strap that encircles an upper arm of the golfer. A separate connector strap connects the chest and arm straps to hold the arm close to the body and properly restrict the arm during the back and forward swings of a golf stroke. The patent teaches against a rigid connection between the chest and arm straps because the patent states that such a rigid connection renders the training of the swing ineffective.

U.S. Pat. No. 6,126,554 issued to Poscente on Oct. 3, 2000, claims a swing training device which constrains both arms of an individual to follow a predetermined swing path. The device includes a member for securing about the torso of an individual and arm bands for securing about the arms of the individual. The arm bands are mounted on guide rails mounted on the torso member through connectors which permit the arm bands to slide along the length of the rails. The arm rails are formed of a rigid material which is resistant to bending out of position.

Several other patents teach various uses of straps to aid in control of the swing movement. However, none of the known prior art teaches a use of straps which not only contains arm movement but provides adequate elasticity to allow a smooth movement but providing a sufficient tightness to control that movement. Moreover, none of the known prior art teaches a training device which can be worn during regular golf outings outside of training.

Therefore there still exists a need for a training device which is simple, compact and provides a combination of control and elasticity to allow a smooth, controlled golf swing.

SUMMARY OF THE INVENTION

The present invention provides a jacket for swing training for a sport requiring swinging of a sports implement. The jacket comprises a body, a first arm and a second arm extending on either side of the body, a front, a back, an interior and an exterior. A first body band encircles the interior portion of the jacket by encircling the body and the interior of the first and second arms. A first wing portion extends from the first arm on the exterior of the jacket, the first wing portion being connected at one end to the first arm and at another end to the exterior of the jacket so that the first wing portion limits the movement of the first arm during a swing.

DETAILED DESCRIPTION OF THE INVENTION

Figure 1:
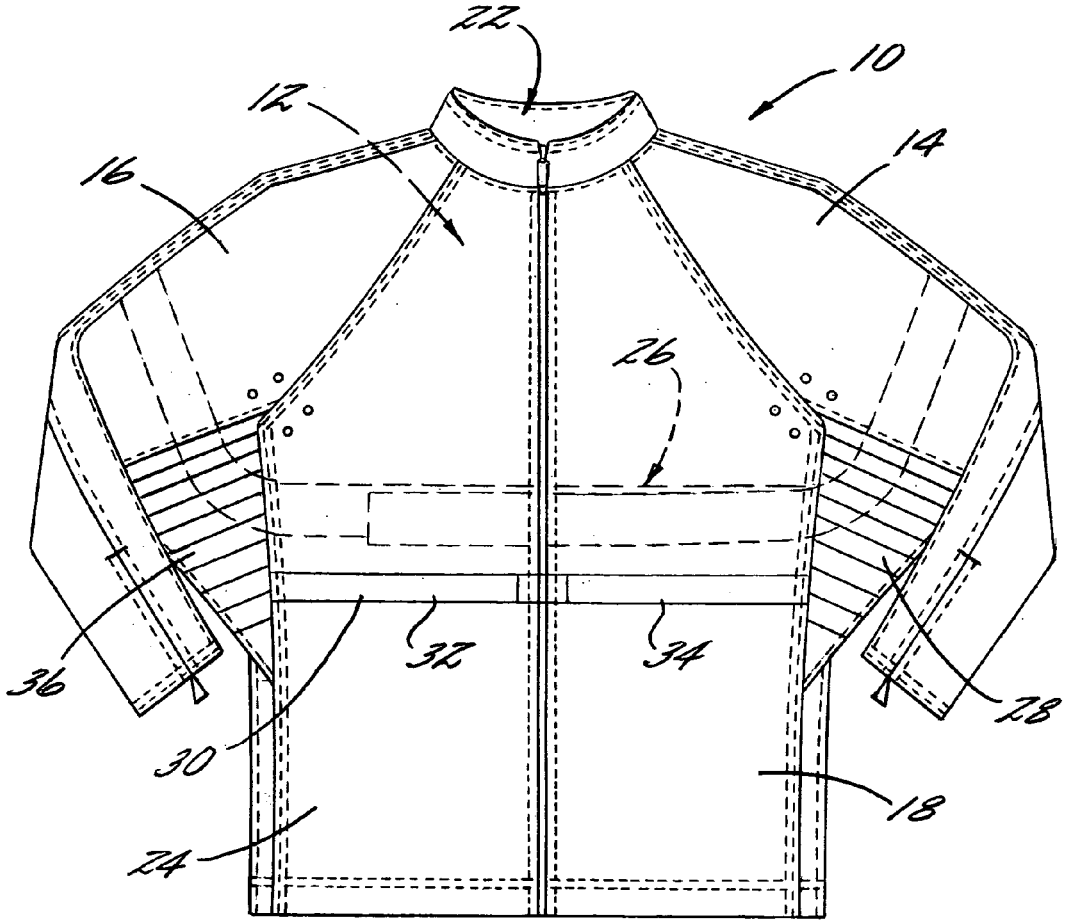
FIG. 1 shows a front view of the exterior of the swing training jacket of the present invention, with dotted lines depicting the body band on the interior of the jacket.
Figure 2:
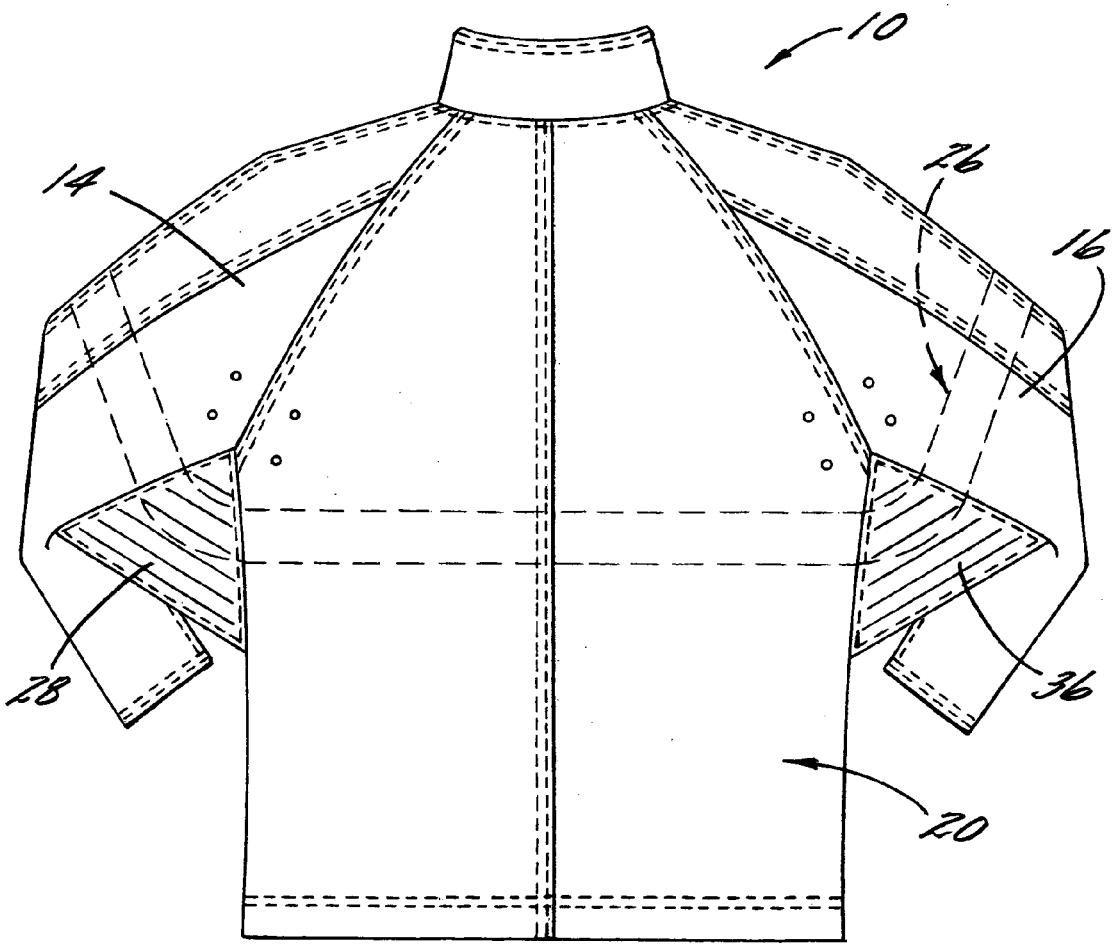
FIG. 2 shows a front view of the exterior of the swing training jacket of the present invention showing the interior

The present invention depicts a jacket 10 for swing training for a sport requiring swinging of a sports implement. Specifically, the jacket 10 is useful for training a golf swing, although other sports are contemplated as being within the scope of the present invention. In golf, a proper back swing and down swing involve a combination of shoulder rotation and the action of the arms to bring the club in the right plane. Specifically, it is essential that the swing motion is smooth so that while the shoulders rotate back during the back swing, the arms are close to the body and the golf club is carried gradually back, using only the upper torso. The movement of the arms and the golf club should create an imaginary arc, with the head of the club remaining close to the ground until the shoulder rotation naturally cause the arms to begin moving backward and upward. The movement should be very controlled so that the arms are kept close to the body during the entire motion. However, many golfers lift the arms without rotating the shoulder and tilt the wrist when attempting the back swing. Moreover, many golfers raise the golf club too soon in the back swing, causing an erratic motion and affecting the resulting down swing. During the down swing, many golfers rush down too fast so that the arms separate from the body. Such errors in shoulder rotation and arm and club alignment and movement are leading causes of poor golf swing technique. Moreover, straps and various other devices taught in the prior art not only are not completely effective in controlling all of the components involved in a golf swing, but can only be used in limited circumstances while training. The present invention provides a jacket 10 that can be worn for a golfer of any skill level. Turning to FIG. 1, the jacket 10 can be used for swing training for a sport requiring swinging of a sports implement, such as a golf club. The jacket 10 comprises a body 12, a first arm 14 and a second arm 16 extending on either side of the body 12. The jacket 10 further comprises a front 18, a back 20, an interior 22 and an exterior 24. A first body band 26 encircles the interior 22 of the jacket 10 by encircling the body 12 and the interior of the first and second arms 14, 16, respectively. The first body band 26 is preferably made of a stretch material so that the first body band 26 provided restraint on both arms of the golfer during a swing motion to keep the arms close to the body.

A first wing portion 28 extends from the first arm 14 on the exterior 24 of the jacket 10. The first wing portion 28 is connected at one end to the first arm 14 and at another end to the exterior 24 of the jacket 10 so that the first wing portion 28 limits the movement of the first arm 14 during a swing. In particular, to avoid a swing that is too rapid or wide, the first body band 26 restrains the arms while the first wing portion 28 keeps the elbows in line, thereby keeping the golfer's body and elbows pointed towards the ground during the swing. The first body band 26 and the first wing portion 28 provide the novel feature of providing the right amount of restraint with elasticity to allow a smooth motion during the swing. It should be noted that the first wing portion 28 may be of various other shapes as contemplated by a person of ordinary skill in the art. The first body band 26 and the first wing portion 28 are preferably constructed of a material that is firm but provides room for stretch, such as fabric with elastic.

The jacket 10 further comprises a second body band 30 that encircles the front 18 of the exterior 24. The second body band 30 further comprises of a left strap 32 and a right strap 34 that connect at a center of the jacket 10. The second body band 30 is a preferable alternative embodiment to provide additional support during swing motion. The second body band 30 may be connected in any means contemplated to be within the ordinary skill in the art.

The jacket 10 further comprises a second wing portion 36, whereby the second wing portion 36 extends from the first arm 14 on the exterior 24 of the jacket 10, the second wing portion 36 being connection at one end to the first arm 14 and at another end to the exterior 24 of the jacket 10 so that the second wing portion 36 limits the movement of the first arm 14 during a swing. Again, to avoid a swing that is too rapid or wide, the first body band 26 restrains the arms while the first wing portion 28 in conjunction with the second wing portion 36 keep the elbows in line, thereby keeping the golfer's body and elbows pointed towards the ground during the swing. The first body band 26, the first wing portion 28 and the second wing portion 36 provide the novel feature of providing the proper amount of restraint with elasticity to allow a smooth motion during the swing. It should be noted that the second wing portion 36 may be of various other shapes as contemplated by a person of ordinary skill in the art. The second wing portion 36 is preferably constructed of a material that is firm but provides room for stretch, such as fabric with elastic.

A preferred measurement for the jacket 10 is provided below in Chart A.

| Points of Measure | Total − | Total + | Reference Spec M | Spec. Meas. Apr. 9, 2003 | Revise Spec Apr. 9, 2003 |
|---|---|---|---|---|---|
| Center Back Length | ½ | ½ | 26 | 27 | 27 |
| Center Front Length | ½ | ½ | | 23 | 23 |
| Center Front Zipper Length | 0 | 0 | 27½ | 24 | 24 |
| Across Back 7" below CB neck | ¼ | ¼ | 18½ | 15 | 15 |
| Across Front 6" Below HPS | ¼ | ¼ | 17½ | 12¼ | 12¼ |
| Chest Circumference 1" Below Armhole | ½ | ½ | 45½ | 44 | 44 |
| Waist Circumference | ½ | ½ | | 43 | 43 |
| Sweep Circumference Measured Straight | ½ | ½ | 44½ | 43 | 43 |
| Muscle Circumference 1" Below Armhole | ½ | ½ | 18 | 15¾ | 15¾ |
| Overarm Sleeve Length from CB Neck | ½ | ½ | 35½ | 35¾ | 35¾ |
| Cuff Circumference - Closed | ¼ | ¼ | 11 | 8½ | 8½ |
| Sleeve Opening Length | 0 | 0 | | 6 | 6 |
| Front Neck Drop From HPS Imag Line | 0 | 0 | 3½ | 2½ | 2½ |
| Back Neck Drop From HPS Imag Line | 0 | 0 | ⅝ | ¾ | ¾ |
| Back Neck Width - HPS to HPS | ¼ | ¼ | 7 | 8 | 8 |
| Collar Length at Outside Edge | ¼ | ¼ | 20 | 19¾ | 19¾ |
| Collar Length at Neck seam | 0 | 0 | 20 | 20½ | 20½ |
| Collar Ht. @ CB | 0 | 0 | 3 | 1⅜ | 1⅜ |
| front reglan sleeve seam length | ½ | ½ | | 10½ | 10½ |
| back reglan sleeve seam length | ½ | ½ | | 17 | 17 |
| sleeve armhole insert height @ center | 0 | 0 | | 7 | 7 |
| sleeve armhole insert length @ bttm | 0 | 0 | | 2½ | 2½ |
| belt length at back panel | 0 | 0 | | 24¾ | 24¾ |
| belt from cb neck seam | 0 | 0 | | 12½ | 12½ |
| belt circ at sleeve | 0 | 0 | | 15 | 15 |
| fr belt length at left wearer's side | 0 | 0 | | 3½ | 3½ |
| fr belt length at right wearer's side | 0 | 0 | | 20 | 20 |

The present invention therefore provides a training tool that restrains the body to create proper positioning during a swing while providing adequate elasticity to create a smooth motion. Moreover, the present invention is uniquely hidden within a jacket to be worn for golfers of all skill levels during any type of play.

It will be clear that the present invention is well adapted to carry out the objects and attain the ends and advantages mentioned as well as those inherent therein. While presently preferred embodiments have been described for purposes of this disclosure, numerous changes may be made which will readily suggest themselves to those skilled in the art and which are encompassed in the spirit of the invention disclosed and as defined in the appended claims.

What is claimed is:

1. A jacket for swing training for a sport requiring swinging of a sports implement, comprising a body portion configurated to fit the torso of a wearer, a first arm and a second arm extending on either side of the body portion, a first wing extending from the first arm to the body portion on the exterior of the jacket so that the first wing limits and controls the movement of the first arm with respect to the body portion, and a first body band encircling the interior of the body portion and the interior of the first arm, and including a portion which extends through the first wing so as to further limit and control the movement of the first arm with respect to the body portion.

2. The jacket of claim 1, wherein the jacket further comprises a second wing extending from the second arm to the body portion on the exterior of the jacket so that the second wing limits and controls the movement of the second arm with respect to the body portion, and wherein the first body band also encircles the interior of the second arm and includes a further portion which extends through the second wing so as to further limit and control the movement of the second arm with respect to the body portion.

3. The jacket of claim 2, wherein the first and second wings each comprise an elastic fabric.

4. The jacket of claim 3 wherein the first body band comprises an elastic material.

5. The jacket of claim 4, wherein the jacket further comprises a second body band which extends across a front of the body portion.

6. The jacket of claim 5, wherein the second body band comprises a pair of straps that connect to each other at the front of the jacket.

* * * * *